US010167604B2

(12) United States Patent
Heichel et al.

(10) Patent No.: US 10,167,604 B2
(45) Date of Patent: Jan. 1, 2019

(54) ROPE-SUSPENDED LEADER MAST

(71) Applicant: DELMAG GmbH & Co. KG, Niedernberg (DE)

(72) Inventors: Matthias Heichel, Aschaffenburg (DE); Nikodemus Heinz, Albershausen (DE)

(73) Assignee: DELMAG GmbH & Co. KG, Niedernberg (DE)

( * ) Notice: Subject to any disclaimer, the term of this patent is extended or adjusted under 35 U.S.C. 154(b) by 669 days.

(21) Appl. No.: 14/821,209

(22) Filed: Aug. 7, 2015

(65) Prior Publication Data

US 2016/0097178 A1 Apr. 7, 2016

(30) Foreign Application Priority Data

Oct. 2, 2014 (EP) ..... 14187401

(51) Int. Cl.

| | |
|---|---|
| ***E02D 3/12*** | (2006.01) |
| ***E02D 5/22*** | (2006.01) |
| ***E02D 7/12*** | (2006.01) |
| ***E02D 7/08*** | (2006.01) |
| ***E02D 7/16*** | (2006.01) |

(52) U.S. Cl.

CPC ..... *E02D 7/125* (2013.01); *E02D 7/08* (2013.01); *E02D 7/16* (2013.01)

(58) Field of Classification Search

CPC ..... E02D 3/12; E02D 5/22

USPC ..... 405/229–256; 173/24–28, 184–189, 173/90–138, 200–212

See application file for complete search history.

(56) References Cited

U.S. PATENT DOCUMENTS

| | | | | |
|---|---|---|---|---|
| 2,998,277 | A * | 8/1961 | Himel, Jr. | B66C 1/14 191/12.2 R |
| 3,243,190 | A * | 3/1966 | Phillips | E02D 13/10 173/130 |
| 3,334,655 | A * | 8/1967 | Eppendahl | B65H 63/028 137/596.2 |
| 3,334,756 | A * | 8/1967 | Whitmire | B66C 23/90 212/280 |
| 3,462,945 | A * | 8/1969 | Stanley | F16G 15/06 294/82.35 |
| 4,473,123 | A * | 9/1984 | Ranft | E02D 7/125 173/1 |
| 4,522,285 | A * | 6/1985 | Salmon | B66B 7/068 104/196 |
| 5,953,901 | A * | 9/1999 | Sidiropoulos | F02C 9/46 60/39.091 |

(Continued)

FOREIGN PATENT DOCUMENTS

| | | |
|---|---|---|
| DE | 77 21 024 U1 | 12/1978 |
| DE | 10 2007 062 301 A1 | 6/2009 |

OTHER PUBLICATIONS

European Search Report dated Mar. 10, 2015 in European Application No. 14187401.6 with English translation.

*Primary Examiner* — Benjamin F Fiorello
*Assistant Examiner* — Edwin J Toledo-Duran
(74) *Attorney, Agent, or Firm* — Collard & Roe, P.C.

(57) ABSTRACT

A rope-suspended leader mast includes a lower part for accommodating a material to be pile-driven and an upper part for accommodating a diesel pile driver having a fuel feed. The leader mast is provided with at least one securing rope. A fuel feed interrupter interrupts the fuel feed of the diesel pile driver accommodated by the rope-suspended leader mast when the securing rope is tensioned.

5 Claims, 1 Drawing Sheet

(56) References Cited

U.S. PATENT DOCUMENTS

| | | | | |
|---|---|---|---|---|
| 6,537,118 | B2 * | 3/2003 | McAlpine | B63B 22/04 441/2 |
| 6,663,154 | B2 * | 12/2003 | Pancheri | B25J 15/0608 294/65.5 |
| 6,736,218 | B1 * | 5/2004 | White | E02D 7/125 173/135 |
| 6,799,597 | B1 * | 10/2004 | Taylor | F16K 17/19 137/458 |
| 7,562,918 | B2 * | 7/2009 | Toma | E05B 47/0047 292/340 |
| 2001/0035122 | A1 * | 11/2001 | Margetts | G01L 5/047 116/283 |
| 2006/0151265 | A1 * | 7/2006 | Honjou | B66D 5/26 188/170 |
| 2009/0309342 | A1 * | 12/2009 | Schonhuber | B60R 21/233 280/737 |
| 2010/0243837 | A1 * | 9/2010 | Cox | A62B 1/04 248/237 |
| 2012/0132298 | A1 * | 5/2012 | Ishitoya | F16K 1/307 137/511 |
| 2012/0175451 | A1 * | 7/2012 | Yanagawa | B60R 22/3413 242/379.1 |
| 2012/0199218 | A1 * | 8/2012 | Gioberti | F16K 17/0486 137/511 |

* cited by examiner

ROPE-SUSPENDED LEADER MAST

CROSS REFERENCE TO RELATED APPLICATIONS

Applicant claims priority under 35 U.S.C. § 119 of European Application No. 14187401.6 filed Oct. 2, 2014, the disclosure of which is incorporated by reference.

BACKGROUND OF THE INVENTION

Field of the Invention

The invention relates to a rope-suspended leader mast, comprising a lower part for accommodating a material to be pile-driven and an upper part for accommodating a diesel pile driver having a fuel feed. The leader mast is provided with at least one securing rope.

Description of the Related Art

Rope-suspended leader masts are regularly used in pile-driving locations that are difficult to access and can be reached only by way of the boom of a crane. Such locations particularly include offshore areas of use. Rope-suspended leader masts generally consist of a lower part, which forms a socket for the material to be pile-driven in and is set onto the material, which part is followed, in the upward direction, by a lattice framework that essentially has a rectangular cross-section and is provided with longitudinal guides, which are used to guide a diesel pile driver displaceably in the interior of the rope-suspended leader mast. Such a rope-suspended leader mast is described, for example, in DE 77 210 24 U1. To secure the rope-suspended leader mast, it is connected with the crane boom by way of a securing rope. In this connection, the securing rope is guided as a slack rope, wherein rope is continuously slackened during the pile-driving process, in order to prevent impairment caused by the rope.

Particularly in the case of non-homogeneous ground conditions, however, it can happen that the material to be pile-driven, and, with it, the rope-suspended leader mast, experiences an unforeseen advancing movement, thereby causing the securing rope to be tensed and the advancing force of the diesel pile driver to be applied to the crane boom. This situation can cause the boom to be severely damaged. In the worst case, tipping of the crane can actually be brought about.

SUMMARY OF THE INVENTION

The invention wishes to provide a remedy for this situation. The invention is based on the task of making available a rope-suspended leader mast of the aforementioned type, in which application of advancing force to the crane boom is reduced in the case of tensioning of the rope. According to the invention, this task is accomplished by means of a rope-suspended leader mast including a lower part for accommodating a diesel pile driver having a fuel feed, which leader mast is provided with at least one security rope. Means are provided for interrupting the fuel feed of the diesel pile driver accommodated by it when the security rope is tensioned.

With the invention, a rope-suspended leader mast of the aforementioned type is made available, in which application of advancing force of the diesel pile driver to the crane boom when the rope is tensed is prevented. According to the invention, an interruption of the fuel feed to the diesel pile driver accommodated by the rope-suspended leader mast takes place when the rope is tensed, thereby causing no further fuel ignition to take place there. As a result, the advancing movement is stopped.

In a further development of the invention, the means for interruption of the fuel feed of the diesel pile driver comprise a movable lever that interacts with an interrupter module that can be introduced into the fuel feed of the diesel pile driver and that is connected with the securing rope in such a manner that its position can be changed by means of tensioning the securing rope, thereby bringing about activation of the interrupter module to interrupt the fuel feed of the diesel pile driver. In this connection, the lever is preferably mounted so as to pivot, and connected with the securing rope at a distance from the pivot axis, wherein the lever, at a distance from the pivot axis, rests on a manipulator of the interrupter module, at least temporarily, by way of which manipulator an interruption of the fuel feed is brought about when the position of the lever changes. The manipulator can be an electrical contact, by way of which activation of the interrupter module takes place. Alternatively, a mechanical or hydraulic actuator can also be provided, by way of which the interrupter module can be activated.

In an embodiment of the invention, the lever is biased in the direction of its basic position, in which the rope is not tensed and the fuel feed is not interrupted, by way of a spring element. In this way, automatic resetting of the lever to its basic position is brought about after the advancing movement has been stopped and the securing rope has been sufficiently allowed to follow, thereby releasing the fuel feed once again. The pile-driving process can thereby be continued without a long-lasting interruption, by raising the piston with subsequent release.

In a further embodiment of the invention, the interrupter module comprises a valve body, by way of which the fuel feed of the diesel pile driver can be interrupted. Depending on the embodiment of the manipulator, this interrupter module can be an electromagnetically controllable valve or also a hydraulically or mechanically manipulable valve. It is advantageous if the interrupter module has a line piece provided with clamp or screw connections, which piece can be introduced into the fuel line of the diesel pile driver to be accommodated by the rope-suspended leader mast.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings, wherein similar reference characters denote similar elements through the several views.

DETAILED DESCRIPTION OF PREFERRED EMBODIMENTS

Figure 1:
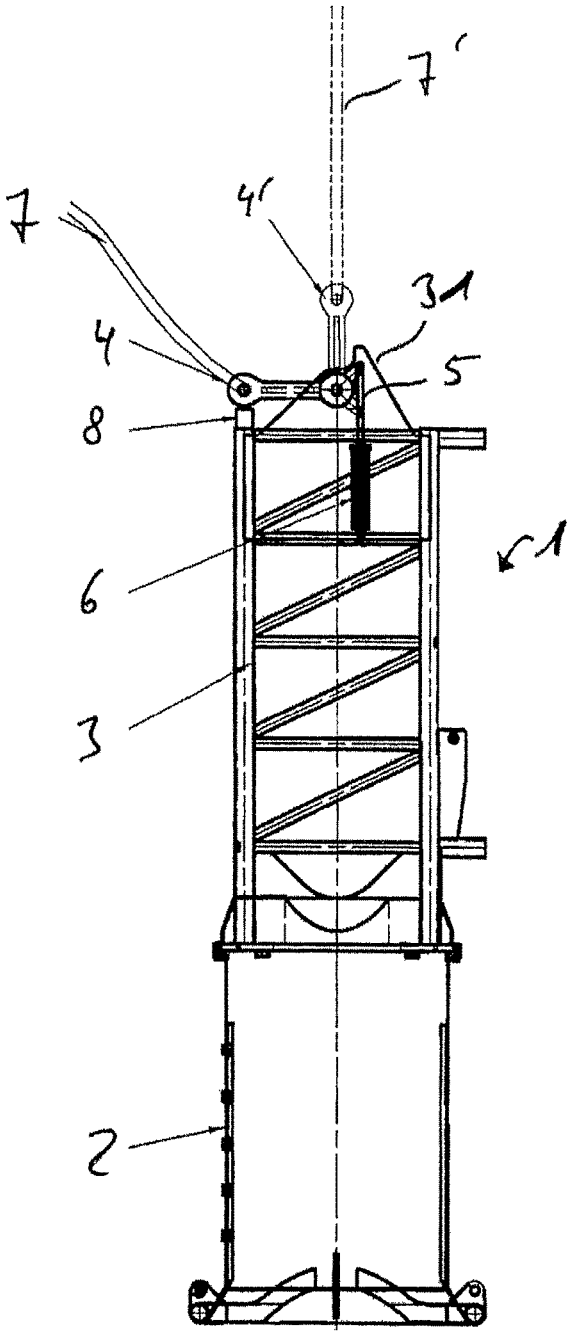
FIG. 1 is a schematic representation of a rope-suspended leader mast.
Figure 2:
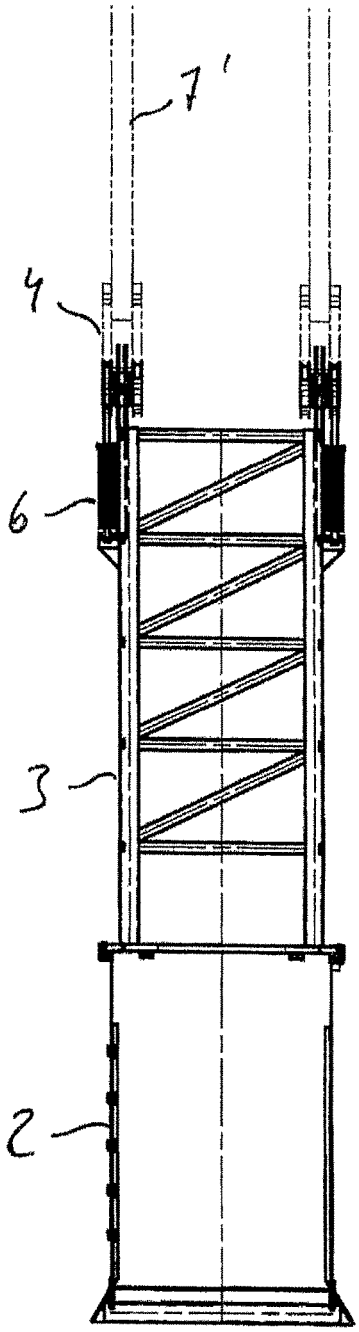
FIG. 2 is a side view of the rope-suspended leader mast from FIG. 1, rotated by 90°.

The rope-suspended leader mast 1 selected as an exemplary embodiment, for accommodating a diesel pile driver—not shown—essentially consists of a lower leader mast part 2 that can be set onto the material to be pile-driven, and an upper leader mast part 3, which is essentially configured in the form of a lattice framework. This lattice framework, structured to be rectangular in cross-section, has four guide tubes—not shown—at its corners, on the inside, on which tubes the diesel pile driver to be accommodated is guided so as to be displaceable in the longitudinal direction, by way of guide arms.

At its end that lies opposite the lower leader mast part 2, two tabs 31 are disposed on the upper leader mast part 3, on which tabs a lever 4 is mounted to as to pivot, in each instance. In the region of their pivotable mounting, the levers 4 are each connected with a piston 5, which is guided in a housing 6 and biased by means of a pressure spring.

With their free end, the levers 4 are pressed, by way of the biased piston 5, against a contact switch 8 that is disposed at a distance from the axis of rotation of the respective lever 4. A securing rope 7 is attached at the free end of the lever 4, in each instance, which rope is connected with the boom of a crane at its other end, for securing purposes.

The contact switch 8 is connected with a solenoid valve disposed in the fuel feed of the diesel pile driver—not shown—that is to be accommodated, in such a manner that when the lever 4 makes contact with the contact switch 8, the flow of fuel is guaranteed, and when the lever 4 is removed from the contact switch 8, the feed of fuel is interrupted.

In FIG. 1, the securing rope 7 is shown in the normal operating position, as a slack rope with the lever 4 resting on the contact switch 8 in the horizontal position, and indicated with a broken line and the reference numeral 7', in the tensed state, with a vertical position of the lever 4 indicated with the reference numeral 4'.

During a pile-driving process, a material to be pile-driven is accommodated by the lower leader mast part, which material is driven into the ground by a diesel pile driver disposed in the rope-suspended leader mast 1. In this connection, the securing rope 7 is allowed to follow as a slack rope. The lever 4 is biased against the contact switch 8 by way of the piston 5. In the event that the material to be pile-driven and the rope-suspended leader mast 1 experience an unforeseen advancing movement because of a sudden change in the ground, and the securing rope is not allowed to follow sufficiently, the rope comes under tension, thereby causing the lever 4 to be pivoted counter to the tension of the pressure spring disposed in the housing 6, thereby interrupting the contact between lever 4 and contact switch 8.

As a result, the solenoid valve connected with the contact switch 8 and disposed within the fuel feed of the diesel pile driver is closed, thereby interrupting the fuel feed of the diesel pile driver. As a result, the pile-driving process is stopped immediately. Possible impairment of the crane boom connected with the securing rope 7 is thereby effectively prevented.

If the securing rope is now allowed to follow, the lever 4 is brought back into its original position by way of the piston 5, which biases the pressure spring, thereby activating the contact switch 8 once again. As a result, the solenoid valve is opened again, thereby causing the fuel feed to be open. The diesel pile driver can thereby be put into operation again immediately.

Although only a few embodiments of the present invention have been shown and described, it is to be understood that many changes and modifications may be made thereunto without departing from the spirit and scope of the invention.

What is claimed is:

1. A rope-suspended leader mast comprising:

(a) a lower part for accommodating a material to be pile-driven;

(b) an upper part for accommodating a diesel pile driver having a fuel feed, the upper part comprising a lattice framework;

(c) at least one securing rope; and (d) a fuel feed interrupter for interrupting the fuel feed, the fuel feed interrupter being configured such that tensioning of the at least one securing rope causes the fuel feed interrupter to interrupt the fuel feed;

wherein the fuel feed interrupter comprises a movable lever that interacts with an interrupter module introduceable into the fuel feed of the diesel pile driver and that is connected with the at least one securing rope in such a manner that a position of the lever is changeable by tensioning the at least one securing rope, thereby bringing about activation of the interrupter module to interrupt the fuel feed of the diesel pile driver;

wherein the fuel feed interrupter is connected to the upper part and is disposed above the upper part; and wherein the at least one securing rope is above the upper part and is connected to the fuel feed interrupter above the upper part.

2. The rope-suspended leader mast according to claim 1, wherein the lever is mounted so as to pivot about a pivot axis and is connected with the at least one securing rope at a distance from the pivot axis, wherein the lever, at the distance from the pivot axis, rests on a manipulator of the interrupter module, at least temporarily, wherein the manipulator brings about an interruption of the fuel feed when the position of the lever changes.

3. The rope-suspended leader mast according to claim 2, wherein the manipulator is formed by an electrical contact, a mechanical actuator, or a hydraulic actuator, for activating the interrupter module.

4. The rope-suspended leader mast according to claim 1, further comprising a spring element biasing the lever toward a basic position, wherein the at least one securing rope is not tensed and the fuel feed is not interrupted when the lever is in the basic position.

5. The rope-suspended leader mast according to claim 1, wherein the interrupter module comprises a valve body for interrupting the fuel feed of the diesel pile driver.

* * * * *